US009463123B2

(12) United States Patent
Peek

(10) Patent No.: US 9,463,123 B2
(45) **Date of Patent: *Oct. 11, 2016**

(54) DYNAMIC SEATING COMPONENTS FOR WHEELCHAIRS

(71) Applicant: American Track Roadster, Inc., Englewood, CO (US)

(72) Inventor: Gregory Alan Peek, Castle Rock, CO (US)

(73) Assignee: AMERICAN TRACK ROADSTER, INC., Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,682

(22) Filed: Nov. 17, 2014

(65) Prior Publication Data

US 2015/0137474 A1 May 21, 2015

Related U.S. Application Data

(63) Continuation of application No. 13/649,826, filed on Oct. 11, 2012, now Pat. No. 8,888,190.

(60) Provisional application No. 61/547,315, filed on Oct. 14, 2011.

(51) Int. Cl.

| | |
|---|---|
| ***A47C 7/50*** | (2006.01) |
| ***A61G 5/12*** | (2006.01) |
| ***A61G 5/10*** | (2006.01) |

(52) U.S. Cl.

CPC ..... *A61G 5/12* (2013.01); *A61G 5/1056* (2013.01); *A61G 2005/128* (2013.01); *Y10T 403/32819* (2015.01)

(58) Field of Classification Search

CPC ..... A47C 7/503; A61G 2005/128; A61G 2005/127

USPC ..... 297/423.19, 423.23, 423.24, 423.25, 297/423.26, 423.37, 423.38, 354.1, 354.12, 297/361.1, 367 R, 367 P, 367 L, 369

See application file for complete search history.

(56) References Cited

U.S. PATENT DOCUMENTS

| | | | | |
|---|---|---|---|---|
| 3,189,385 A * | 6/1965 | Mommsen | ..... | A61G 5/12 188/DIG. 2 |
| 3,205,006 A * | 9/1965 | Mommsen | ..... | A61G 5/12 248/214 |
| 3,321,239 A * | 5/1967 | Cosper | ..... | A61G 5/00 297/423.26 |
| 3,758,150 A * | 9/1973 | Williams | ..... | A61G 5/08 297/411.2 |

(Continued)

FOREIGN PATENT DOCUMENTS

| | | |
|---|---|---|
| JP | 2004-033597 A | 2/2004 |
| JP | 2007-152043 A | 6/2007 |
| WO | 2013-055912 A1 | 4/2013 |

OTHER PUBLICATIONS

PCT International Search Report and Written Opinion in International Application PCT/US2012/059739, Mailed Mar. 18, 2014, 13 PGS.

*Primary Examiner* — Rodney B White

(57) ABSTRACT

A wheelchair includes a pivotable mechanism. The pivotable mechanism allows for a pivoting movement about an axis defined by an interface between adjacent components. These components may be (a) a seat member and a back member, (b) a seat member and a footrest, (c) a foot rest and a footplate support, (d) a baseplate and a footplate, or (e) a back member and a headrest.

16 Claims, 11 Drawing Sheets

(56) References Cited

U.S. PATENT DOCUMENTS 3,790,212 A * 2/1974 Suyetani ..... A61G 5/12 297/423.19
4,120,532 A * 10/1978 Clanan ..... A61G 5/12 297/423.19
4,176,879 A * 12/1979 Rodaway ..... A61G 5/12 297/423.26
4,572,576 A * 2/1986 Minnebraker ..... A61G 5/12 297/423.19
4,805,931 A 2/1989 Slasor et al.
4,813,693 A * 3/1989 Lockard ..... A61G 5/00 280/304.1
4,887,826 A * 12/1989 Kantner ..... A61G 5/08 280/250.1
4,917,395 A 4/1990 Gabriele
4,957,303 A * 9/1990 Romatz ..... A61G 5/12 280/250.1
4,981,305 A * 1/1991 Lockard ..... A61G 5/00 280/250.1
5,028,065 A 7/1991 Danecker
5,393,082 A * 2/1995 Fenley ..... A61G 5/12 280/291
5,494,334 A * 2/1996 Zvonik ..... A47C 1/04 297/344.19
5,522,644 A * 6/1996 Peek ..... A47C 7/503 297/423.26
5,713,591 A * 2/1998 Zarkhin ..... A61G 5/12 248/118.3
5,725,281 A * 3/1998 Vairinen ..... A47C 1/03 297/423.26
6,129,415 A * 10/2000 Galloway ..... A61G 5/1067 297/423.26
6,286,904 B1 * 9/2001 Obertelli ..... A61G 5/10 297/423.19
6,422,653 B1 * 7/2002 Szczepanski ..... A61G 5/12 280/291
6,585,279 B1 * 7/2003 Galloway ..... A61G 5/006 280/304.1
6,773,073 B1 * 8/2004 Escobedo ..... A61G 5/12 280/304.1
6,789,848 B2 * 9/2004 Rauschenberger .... A47C 1/026 297/354.12
7,331,632 B2 * 2/2008 Wendt ..... A61G 5/12 280/291
7,360,840 B2 * 4/2008 Barlow ..... A61G 5/12 280/304.1
7,367,578 B2 * 5/2008 Jansen ..... A61G 5/12 280/304.1
7,425,010 B2 * 9/2008 Harris ..... A61G 5/12 280/304.1
7,487,989 B2 * 2/2009 Crosby, II ..... A61G 5/12 280/250.1
7,635,142 B2 * 12/2009 Slagerman ..... A61G 5/12 280/291
8,403,420 B2 * 3/2013 Billescas ..... A61G 5/12 280/250.1
8,573,610 B1 * 11/2013 Meyers ..... A61G 5/12 280/47.4
8,888,190 B2 * 11/2014 Peek ..... A61G 5/1056 297/423.19
2007/0057561 A1 * 3/2007 Liao ..... A61G 5/12 297/423.19
2012/0098313 A1 * 4/2012 Cartis ..... A47C 7/448 297/354.12
2013/0249190 A1 * 9/2013 Engman ..... A61G 5/12 280/291
2013/0292988 A1 * 11/2013 Jeyasurya ..... A61G 5/14 297/423.26

* cited by examiner 300
322
304
316
306
312
318
R
308
314
310
320
318
302

322
300
304
306
316
318
308
312
314
310
320
318
F

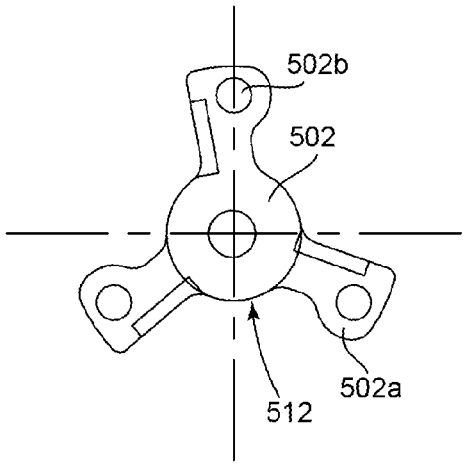
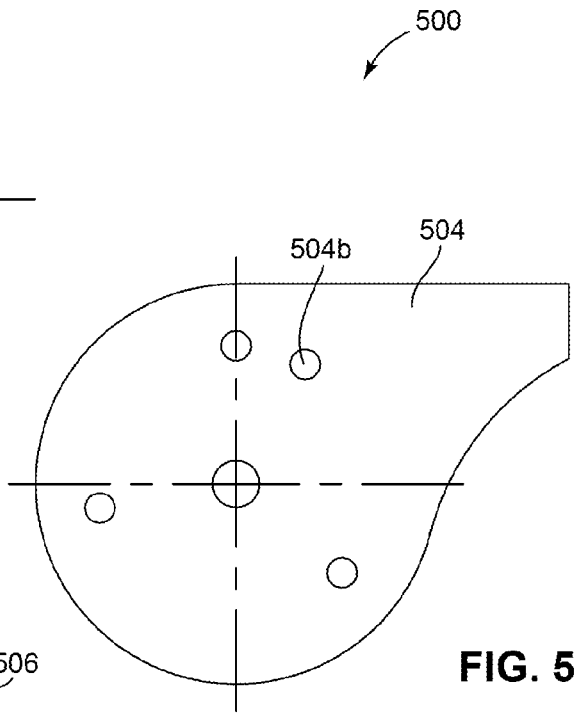
FIG. 5B
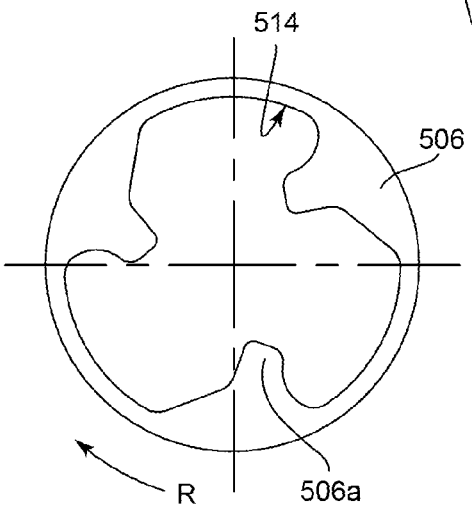
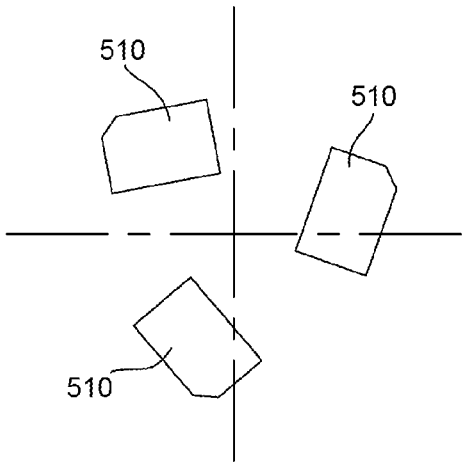

DYNAMIC SEATING COMPONENTS FOR WHEELCHAIRS

CROSS-REFERENCE TO RELATED APPLICATIONS

This application is a continuation application of U.S. patent application Ser. No. 13/649,826, filed Oct. 11, 2012, now U.S. Pat. No. 8,888,190; which claims priority to and the benefit of U.S. Provisional Patent Application No. 61/547,315, filed Oct. 14, 2011, entitled "Dynamic Seating Components for Wheelchairs," the disclosures of which are hereby incorporated by reference herein in their entireties.

INTRODUCTION

Certain types of individuals have medical conditions that cause exaggerated muscle behaviors. For example, individuals with imbalanced muscle tone, often as a result of an anoxic birth injury, cerebral palsy or an acquired/traumatic brain injury, may display strong patterns of either flexion or extension, for example, in the muscles of the hip. This can occur numerous times during a day, often triggered by intention or mood change (excitement, anger, etc.). When the extension is initiated by hip movement (hip extension), the angle between the individual's upper legs and back changes. When this pattern is met by resistance from a traditional seating system, the tone pattern is exaggerated and continued. However, it has been discovered that when there is some "give" or lack of resistance of the support surfaces, the tone pattern is reduced, thus relaxing the muscles that are firing. Tone changes or movement in the lower extremities (i.e., below the hip) are also common. As noted above, the extensor pattern displayed can be lessened when the extension pattern is not met with resistance. Once the resistance is eliminated, the tone pattern is compelled to relax.

Many individuals with mental disabilities, often times along with diagnoses of cerebral palsy, exhibit the need to participate in self-stimulatory behaviors. These are driven by the individual's internal drive to gain certain types of vestibular, proprioceptive and tactile input. As a result, many individuals participate in rocking behaviors. The rocking motion can be limited to head movement or can include total body rocking while seated. When seated in a traditional wheelchair with a fixed seat-to-back angle, this movement often causes damage to the wheelchair, making it unsafe for use. Excessive wear and tear on the wheelchair may cause failure of some parts. Often, rear canes or seat rails shear, making the chair unusable.

Individuals that display any of the above or similar conditions are often, by the nature of their disability, confined to wheelchairs. However, these conditions make the use of traditional wheelchairs (i.e., those having static seating components) less than desirable. Any of these static components may be subject to premature failure because of the involuntary abusive use caused by the individual's exaggerated, often violent, movements. It is not uncommon to have the backrest structure broken off of a wheelchair, rendering the wheelchair unusable. Standard wheelchair footrests and their mounting components are often bent outward by the user who experiences extension thrusting. When the hip extensor tone is fired, the user will exert tremendous force on opposite ends of the wheelchair, pushing against the top of the seat back and against the footplates. The force on the footplates is typically both outward and upward.

When a wheelchair is damaged to the point that it is unusable, the cost goes far beyond the obvious financial cost of repairing or replacing the wheelchair. The inconvenience of not having a wheelchair or having an inappropriate temporary replacement has an impact on the user and their caregivers. In today's medical funding environment, it is also difficult to have a wheelchair repaired. The facility doing the repair work almost always needs approval from the funding source (Medicare, Medicaid, or private insurance) prior to doing the repairs. The repair process typically involves sending a technician to the field to evaluate the problem and report to the medical billing department for the paperwork process to be initiated. Thereafter, quotes are required for parts and must be submitted for prior approval for the repairs. When approval is given, and it may occasionally be withheld at least temporarily, the parts must be ordered. Upon receipt of the parts, an appointment must be made to pick up the wheelchair, then repair and return the wheelchair to the customer. The entire process can take a lengthy period of time, often weeks or months.

SUMMARY

In one aspect, the technology relates to a dynamic foot plate for a wheelchair, the dynamic foot plate including: a base plate adapted to be secured to a wheelchair; at least one flexible element secured at a first end to the base plate; a foot plate secured to a second end of the at least one flexible element, such that in a neutral position, the foot plate is substantially parallel to the base plate and such that when a force is applied to the foot plate, the flexible element deflects so as to allow the foot plate to be oriented at an angle to the base plate. In an embodiment, the base plate and the foot plate are secured to the flexible element with a fastener that passes through the flexible element. In another embodiment, the at least one flexible element includes a plurality of flexible elements. In yet another embodiment, the at least one flexible element includes four flexible elements, wherein the four flexible elements are disposed substantially centrally on the foot plate.

In another aspect, the technology relates to a telescoping footrest for a wheelchair, the telescoping footrest including: a tube defining an interior; an elongate element slidably received within the interior of the tube; and a deformable element for controlling sliding movement of the elongate element within the interior of the tube. In an embodiment, the deformable member includes a compressible element. In another embodiment, the elongate element includes an elongate flat guide surface, and wherein the telescoping footrest further includes a guide adapted to slide relative to and along the elongate flat guide surface so as to prevent an axial rotation of the elongate element relative to the tube. In yet another embodiment, the footrest includes a foot support element secured to at least one of the tube and the elongate element.

In another aspect, the technology relates to a pivotable mechanism for a wheelchair, the pivotable mechanism including: an axle including at least one axle projection projecting from an outer surface of the axle; an annular hub including at least one hub projection projecting from an inner surface of the hub, wherein the axle is located within the hub; a biasing element located between the axle projection and the hub projection, such that rotation of at least one of the hub and the axle causes at least one of a compression and an extension of the biasing element. In an embodiment, the axle includes a plurality of axle projections, and wherein the hub includes a corresponding plurality of hub projections. In another embodiment, the pivotable mechanism further includes a plurality of biasing elements corresponding to the plurality of axle projections and the plurality of hub projections. In yet another embodiment, the biasing element is a compressible element.

In another aspect, the technology relates to a wheelchair having a pivotable mechanism as described above, wherein the pivotable mechanism allows for a pivoting movement about an axis defined by an interface between at least one of (a) a seat member and a back member, (b) a seat member and a footrest, (c) a foot rest and a footplate support, (d) a baseplate and a footplate, and (e) a back member and a headrest.

In another aspect, the technology relates to a wheelchair having: a first dynamic component including a first pivotable mechanism for allowing a pivoting movement about a first axis defined by an interface between a seat member and a back member, wherein the first dynamic component includes a biasing element for biasing the first dynamic component into a rest position; and a second dynamic component including a second pivotable mechanism for allowing a pivoting movement about a second axis defined by an interface between at least one of (a) a seat member and a back member, (b) a seat member and a footrest, (c) a foot rest and a footplate support, (d) a baseplate and a footplate, and (e) a back member and a headrest, wherein the second dynamic component includes a biasing element for biasing the second dynamic component into a rest position. In an embodiment, the wheelchair further includes a third dynamic component including a telescoping element for allowing an axial movement of a first footrest element relative to a second footrest element, wherein the third dynamic component includes a biasing element for biasing the third dynamic component into a rest position. In another embodiment, the wheelchair further includes a fourth dynamic component for allowing a pivoting movement about an axis substantially orthogonal to a baseplate. In yet another embodiment, the second axis is substantially orthogonal to the first axis.

BRIEF DESCRIPTION OF THE DRAWINGS

There are shown in the drawings, embodiments which are presently preferred, it being understood, however, that the technology is not limited to the precise arrangements and instrumentalities shown.

FIG. 5B is an exploded side sectional view of the pivoting connection of FIG. 5A.

DETAILED DESCRIPTION

Adaptive or dynamic components act as shock-absorbing devices, receive the energy exerted by the user and absorb it into the device, thus alleviating or eliminating the above-mentioned problems attendant with fixed components. Absorbing the energy into the dynamic component reduces the energy absorbed into the wheelchair itself, thereby minimizing the potential for breakage of the wheelchair components. Additionally, dynamic components in the wheelchair can help control or lessen the user's condition or behavior which causes the damage. Dynamic seating components for wheelchairs are needed to prevent or eliminate damage to wheelchairs resulting from severe usage, typically involving involuntary and sometimes violent movements of the wheelchair user. Dynamic components may be used in numerous locations on the wheelchair. Any standard component subjected to abnormally high forces exerted by the user may be replaced with dynamic components.

Figure 1:
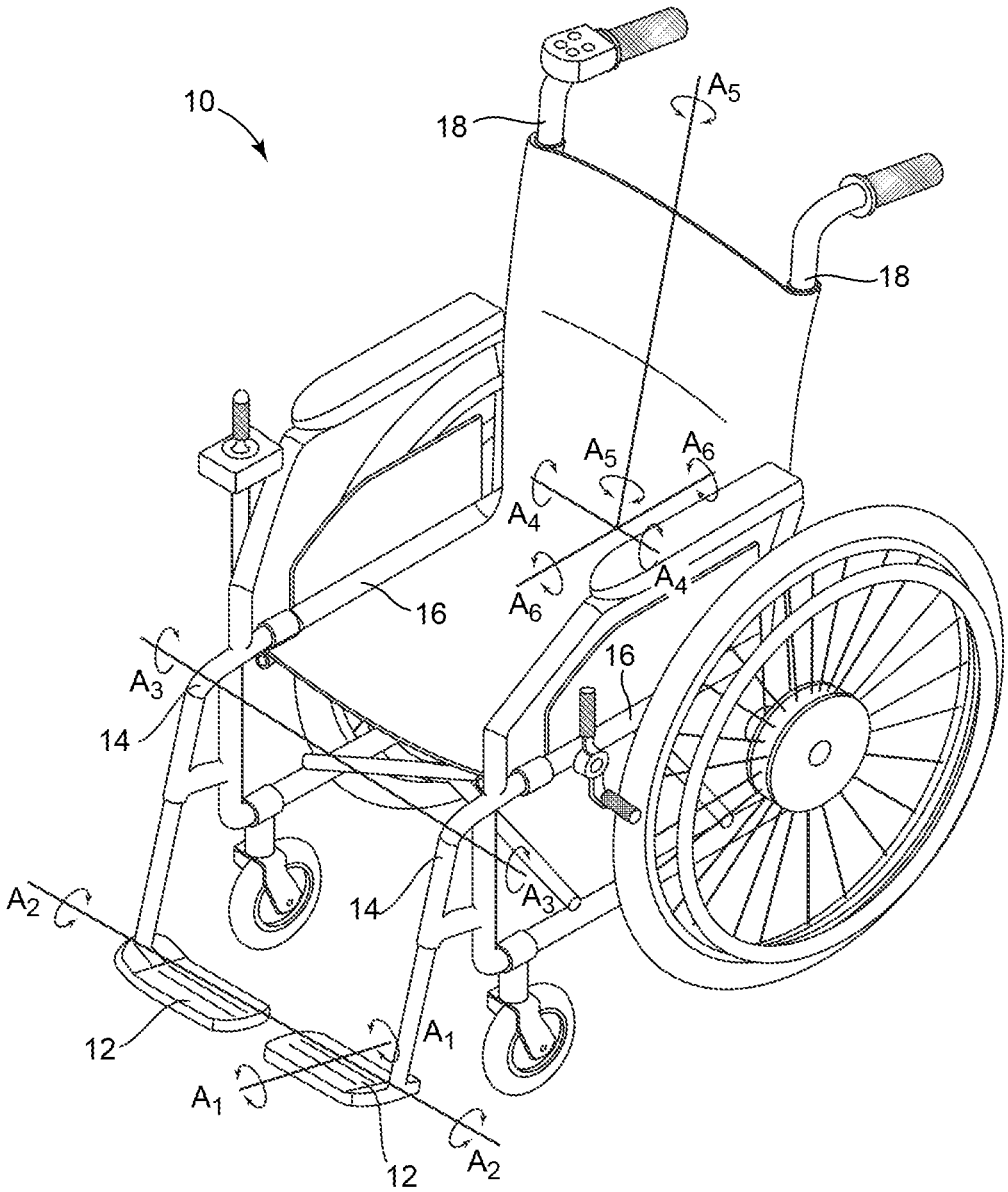
FIG. 1 is a perspective view of a wheelchair.

Exemplary components of a wheelchair upon which excessive forces may be exerted include the headrest, backrest, seat frame, footrest, and the footplate. FIG. 1 depicts a wheelchair 10 including footplates 12, footrests 14, seat frame members 16, and backrest members 18. A number of axes are depicted that are associated with forces acting upon the wheelchair 10 by an individual. Certain individuals may pronate or supinate their feet, thereby exerting a rotational force about footplate axis $A_1$. Individuals may also flex their ankles, in the plantar and/or dorsal directions, exerting another rotational force about footplate axis $A_2$. Of course, forces applied to the footplates need not cause rotational forces exclusively around axis $A_1$ or axis $A_2$. Some forces may comprise force components in several directions (i.e., the rotational forces may be acute to both axes $A_1$ and $A_2$). The knee may move in either or both of extension or flexion directions and apply forces about an axis $A_3$. Forces comprising multiple vector components may be applied to the backrest. For example, many individuals exert force against the backrest, causing a rearward rotational force about an axis $A_4$. Such a force would be similar in directional components to the force about axis $A_4$. Additionally, a twisting rotation of the spine may also occur, thus applying a force to the backrest about an axis $A_5$. Also, a leaning rotation may occur, thus applying a force about an axis $A_6$ that is generally perpendicular to both axes $A_4$ and $A_5$. Similarly, and although not shown, an individual may exert one or more forces against a headrest. It will be apparent to a person of skill in the art that an individual may apply forces due to excessive movement about any or all of the depicted axes $A_1$-$A_6$. Certain movements may result in forces about multiple axes, for example, an individual rocking rearward in the wheelchair 10 while twisting at the shoulders may exert forces about both axes $A_4$ and $A_5$. If that individual also extends their legs at the same time, forces may be exerted about axis $A_3$. In general, the axes $A_1$-$A_6$ correspond to interface between adjacent components. For example, axis $A_3$ corresponds to the interface between the footrest 14 and seat frame member 16.

Figures 3A, 3B:
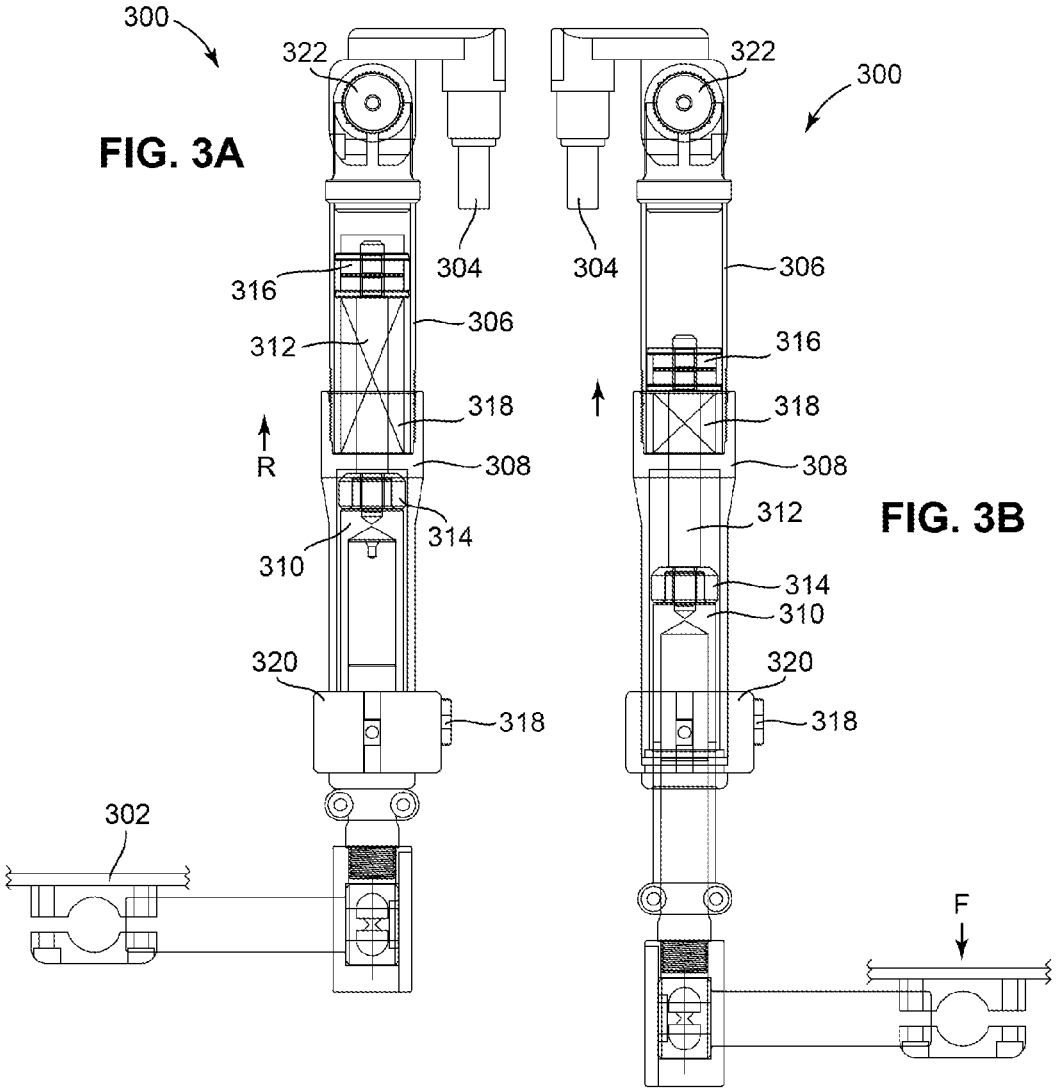
FIG. 3A is a side sectional view of a telescoping wheelchair footrest in a retracted position.
FIG. 3B is a side sectional view of a telescoping wheelchair footrest in an extended position.

A number of components are described herein that help limit the forces exerted by an individual against a wheelchair, thus reducing the stresses against both the individual and the wheelchair. This helps reduce the movements and behaviors of the wheelchair user and can also prolong the operational life of the wheelchair. These components include dynamic footplates (as depicted in FIGS. 2A and 2B)

and dynamic footrests (FIGS. 3A and 3B). Additionally, two types of rotating components, depicted in FIGS. 5A-6C may be incorporated into any or all of the footplate, footrest, seat frame members, backrest members, and headrest of the wheelchair, such that multiple degrees of rotation are possible. A wheelchair including all of the technologies described herein may include dynamic pivoting components at the footplate, dynamic telescoping components at the footrest, and dynamic pivoting components at the footrest/seat member interface, the seat member/back member interface, and the back/headrest interface. The maximum allowable movement may be defined by the flexibility of any cushioning elements, as well as the presence of any limiting elements. Of course, a wheelchair need not include all of these dynamic elements. Any combination of elements, or even just a single element, may provide a degree of movement typically lacking in standard wheelchairs.

Additionally, these components may be used in wheelchairs used for individuals that lack the above-identified medical conditions, but who may benefit from the increased comfort attendant with the dynamic components described herein. These individuals may be obese or have extremities that extend in atypical directions and would benefit from improved component positioning. Additionally, dynamic components may be used in wheelchairs used by paraplegics or quadriplegics, allowing the chair components to conform to the position of the body, not vice versa. In short, the components depicted and described herein allow the wheelchair to better fit the individual, whether that individual moves or not. Accordingly, the components may also be considered adaptive in that they adapt to the particular position of the user. Of course, these components may also be incorporated into stationary or semi-mobile chairs or physical therapy equipment or any type of seating device in which an individual spends time. The components disclosed herein may incorporate different technologies to better conform to the needs of the individual. They may be used independently or any combination and are described in further detail below.

Figure 2A:
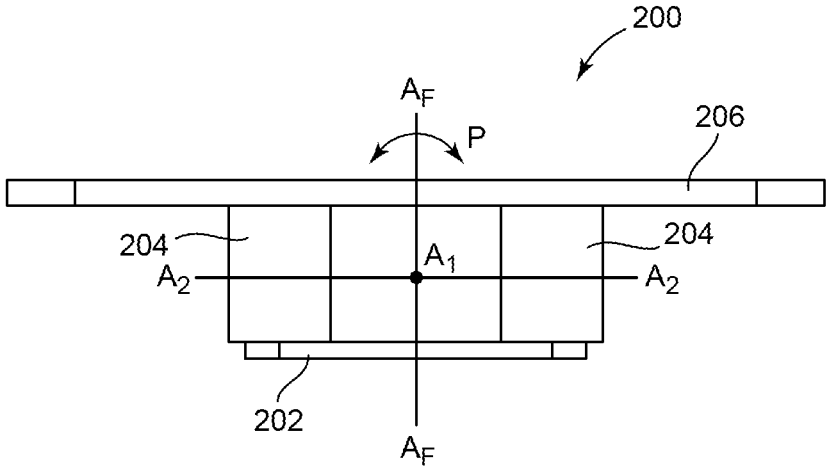
FIGS. 2A and 2B are front and bottom views, respectively, of a wheelchair footplate.
Figure 2B:
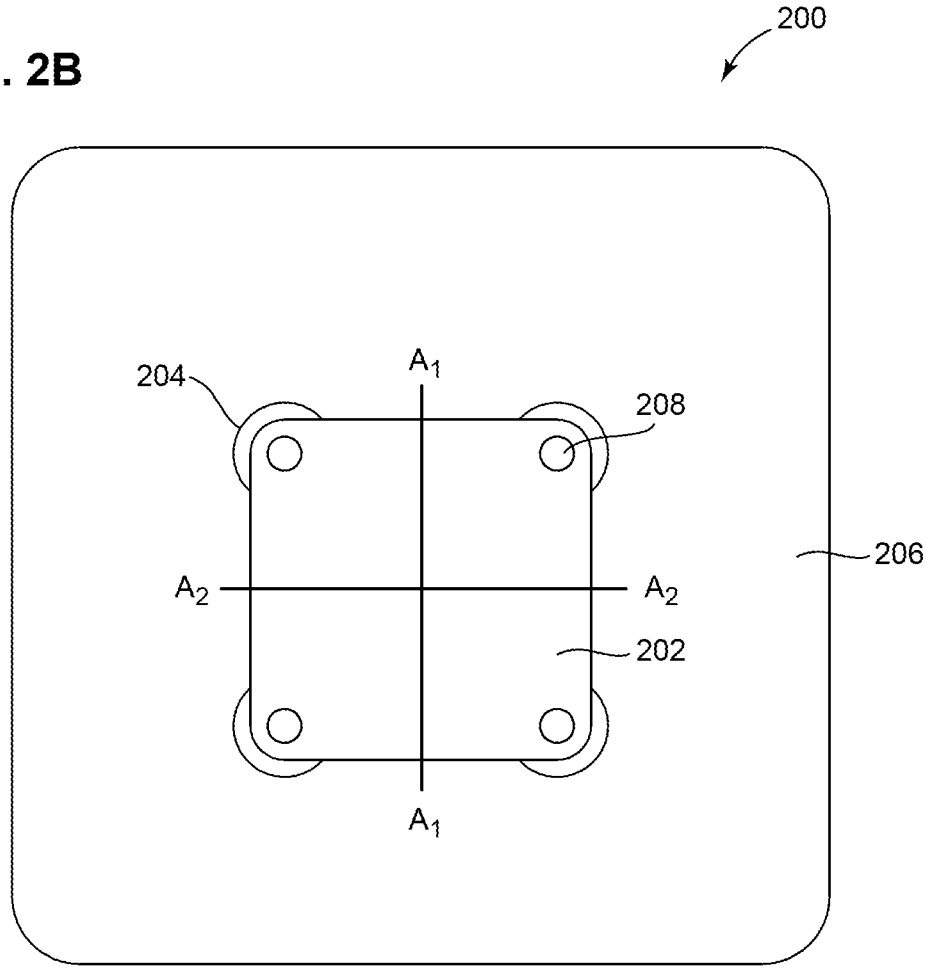

FIGS. 2A and 2B depict side and bottom views, respectively, of an adaptive footplate 200 or foot support element. The footplate 200 includes a mounting or base plate 202 that may be connected to a plate support post or to an existing footplate extending from a footrest. Elastomers 204 are secured to the base plate 202 and an upper footplate 206 with fasteners 208. The elastomers 204 allow flexibility for both compression and planar deflection. Pressure applied at any point about the perimeter of the footplate 206 will cause deflection/compression of the elastomers 204 resulting in the footplate 206 moving such that it is temporarily not parallel with the base plate 202. When pressure is released, the footplate 206 returns to the original position. The depicted embodiment includes four elastomers 204, but any number may be used. The elastomers 204 allow the footplate 206 to rotate about an axis $A_F$ substantially orthogonal to the mounting plate 202, with little limitation. This rotation is depicted as pivoting movement P in FIG. 2. Of course, movement P of the plate 206 is not limited to side-to-side and back-and-forth movement. Instead, omnidirectional movement about the axis depicted is possible due to the configuration of the elastomers. Axes $A_1$ and $A_2$ (orthogonal to axis $A_1$) are also depicted. Thus, it is clear that forces applied to the footplate 206 in virtually any direction may be accommodated by the dynamic footplate 200.

The technologies described herein improve, e.g., the lower extremity support surfaces of a wheelchair, commonly known as footrest or legrest. Footrests typically are attached to the wheelchair seat frame member in a fixed angular position, usually at 90°, 70°, or 60° to the horizontal axis or wheelchair seat frame. Legrests are similar to footrests except that they start at an angle to the seat frame similar to a footrest and then have the ability to elevate to a point where the legrest extends more or less straight out from the seat, becoming an extension of the seat and capable of supporting the full weight of the legs.

FIG. 3A depicts a telescoping footrest 300 to allow the distance from a seat (not shown) to the footplate 302 to vary (i.e., extend and return). The footrest 300 includes a connection post 304, an upper housing 306, a lower housing 308, and an extension rod 310. In the depicted embodiment, the extension rod 310 is slidably received in the lower tubular housing 306. A connecting rod 312 is connected to the extension rod 310 at a lower piston 314. The connecting rod 312 extends into the upper housing 306 and is guided by an upper bushing 316. The upper housing 306 also includes a deformable spring element 318, which may be a compression member such as an elastomer or a compression spring. Alternatively, an extension spring may be used. As a force F is applied to the footrest 302, the extension rod 310 telescopes down, but is biased into the upper position (of FIG. 3A) by a return force R of the spring element 318. In that regard, the spring element 318 helps control sliding movement of the extension rod 310. An elongate flat guide surface (not shown) aligned axially along an outside curved surface of the extension rod 310 interfaces with a guide (not shown). These elements reduce or prevent axial rotation of the extension rod 310, such that movement thereof is only substantially linear. Force applied against the guide may be adjusted by a guide adjustment screw 318 located on the clamp housing 320. Alternatively, a key on the extension rod and a keyway defined by the lower housing may be used to prevent rotation of the extension rod relative to the lower housing. In alternative embodiments not using rotation prevention elements, however, the spring element 318 may allow minor axial rotation of the extension rod 310, while preventing significant rotation. This would provide yet another degree of freedom for the footrest 302, which may be helpful for individuals whose feet splay outward during extension. The footrest 300 of FIGS. 3A and 3B may utilize a mount 322 to the wheelchair seat frame (via the connection post 304). Such a mount may be fixed, adjustable, or dynamic, as described in embodiments below.

Figure 4:
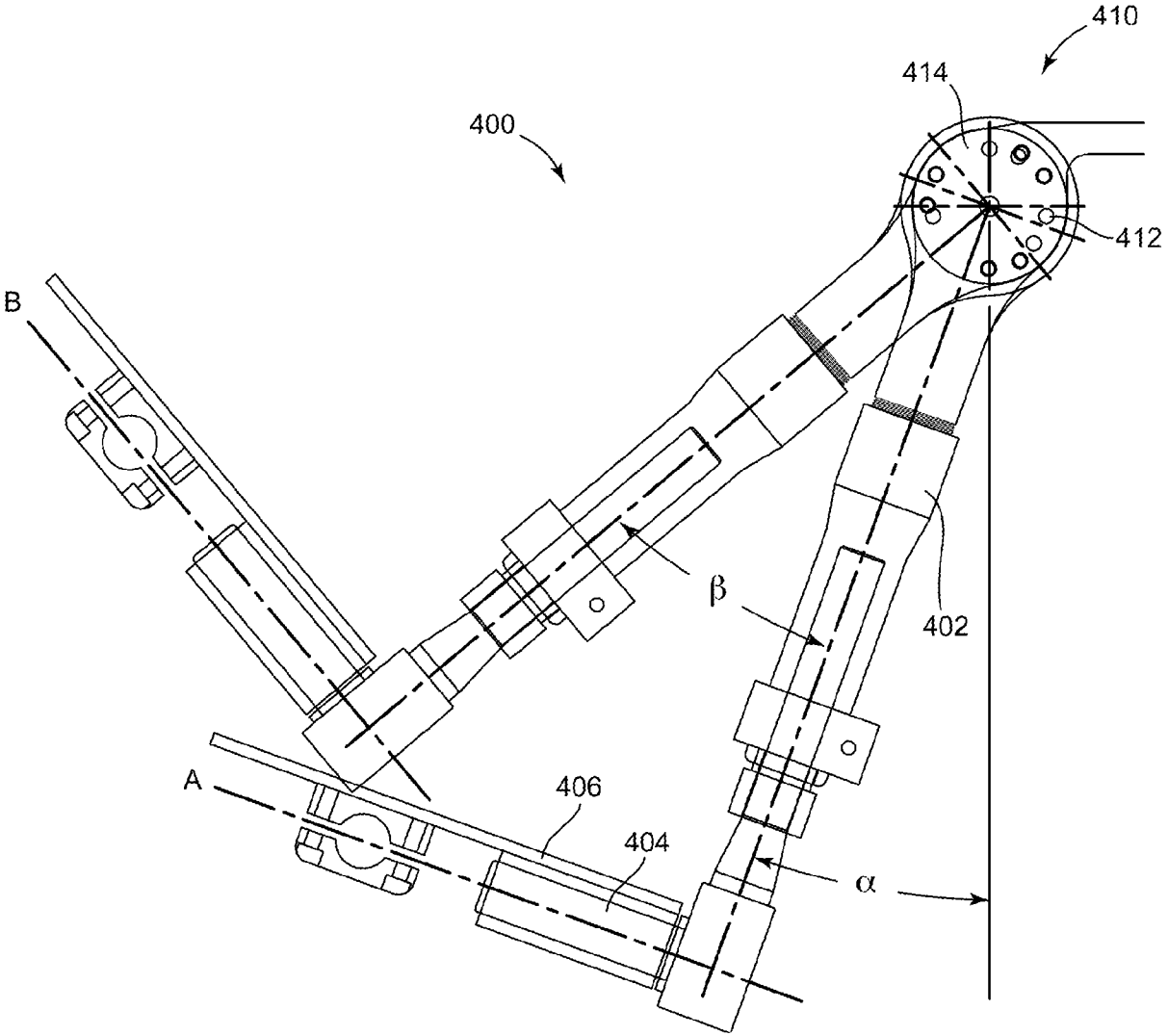
FIG. 4 is a side section view of a pivoting wheelchair footrest in a first position and a second position.
Figure 5A:
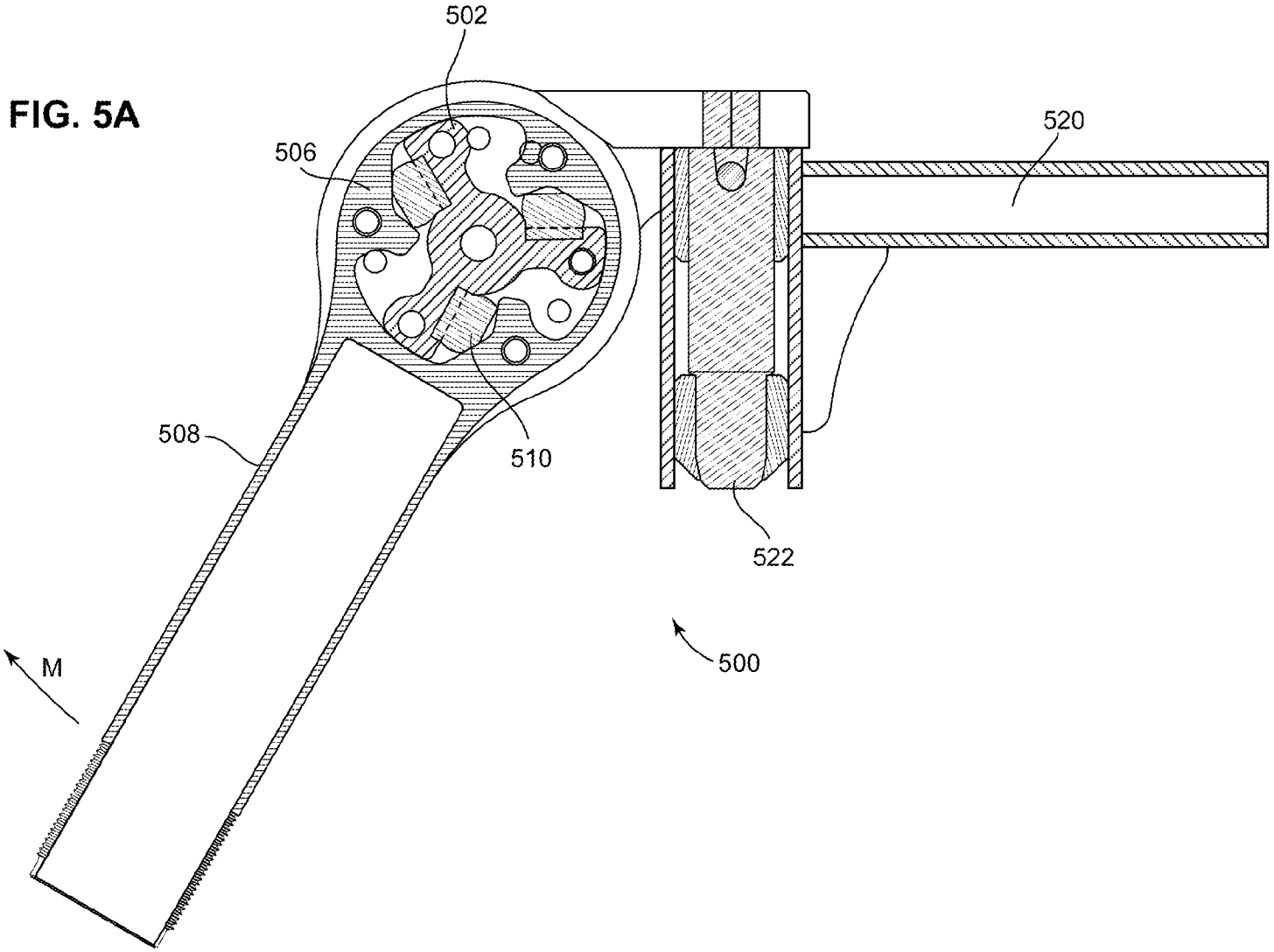
FIG. 5A is a side sectional view of a pivoting connection on a footrest.

FIG. 4 depicts a dynamic footrest 400 in a first position A and a second position B. The footrest 400 may include the telescoping components of FIGS. 3A and 3B, or may be a fixed component. For the purposes of this description, the dynamic foot rest 400 includes a leg 402, a footplate post 404, and a footplate 406. Other components are described below. Two positions of the footrest 400 are depicted. The first position A is an initial or rest position, defined by an angle $\alpha$ from a vertical datum 408. This angle $\alpha$ may be set to any desired angle. The initial angle $\alpha$ may be set as desired from about 20° to about 50° from the datum 408, depending on the preferences or limb orientation of the individual using the wheelchair. Setting of the initial angle $\alpha$ may be performed by inserting a pin through one of several openings 412 defined by an outer plate 414 of a pivotable connection 410. This pin penetrates an opening defined by the axle (as depicted in FIGS. 5A and 5B), thus setting the initial position of the axle. Angular range of dynamic travel $\beta$ is also depicted, and represents the maximum amount of travel available for the footrest 400. This angle $\beta$ may be up to about 30° from the angle $\alpha$ to the second position B, as required or desired for a particular application. Embodiments of pivoting connections 410 that enable the movement of the footrest 400 (as well as other components) are described below.

A pivotable connection 500 depicted in FIGS. 5A and 5B and may be used for any connection where pivotal movement is expected, e.g. about axles $A_1$-$A_6$, as described above. One such connection would be a rotary joint in close proximity to the knee, between an upper portion of the footrest and the seat frame member. Typically, wheelchair footrests are at a fixed angle relative to the seat which is typically 60°, 70°, or 90°. Use of a dynamic connection allows for rotation through a range of motion. This will simulate a partial range of motion of the user's knee joint while absorbing energy exerted by the user. The connection 500 includes an axle 502 fixed to two side plates 504 (only one of which is shown), which may be secured to the seat frame 520 via the connection element 522. Both the axle 502 and the side plates 504 define a number of openings 502*b*, 504*b*, that may receive a pin as described above to set the initial position of the axle 502. A moveable hub 506 is secured to an upper housing 508 of the footrest and rotates about the axle 502. In an alternative embodiment, the hub 506 may be fixed and the axle 502 moveable. The axle 502 and hub 506 include a number of projections 502*a*, 506*a*, each having a biasing element 510 located therebetween. In the depicted embodiment, the axle projections 502*a* extend from an outer surface 512 of the axle 502, and the hub projections 506*a* extend from an inner surface 514 of the hub 506. Not all types of biasing elements 510 would necessitate the inclusion of the projections 502*a*, 506*a*, and certain embodiments may use fewer than the number of projections depicted, or more than the number of projections depicted. As with the other biasing elements described herein, these elements may be compression springs or elastomers. Alternatively, the elements may be extension springs or torsion springs. Elastomers are particularly desirable because of their resistance to corrosion and because they may be manufactured with a wide range of compressive resistance. As the hub 506 rotates R due to movement M of the footrest 508, the biasing elements 510 compress between the opposed projections 502*a*, 506*a*.

Figure 6A:
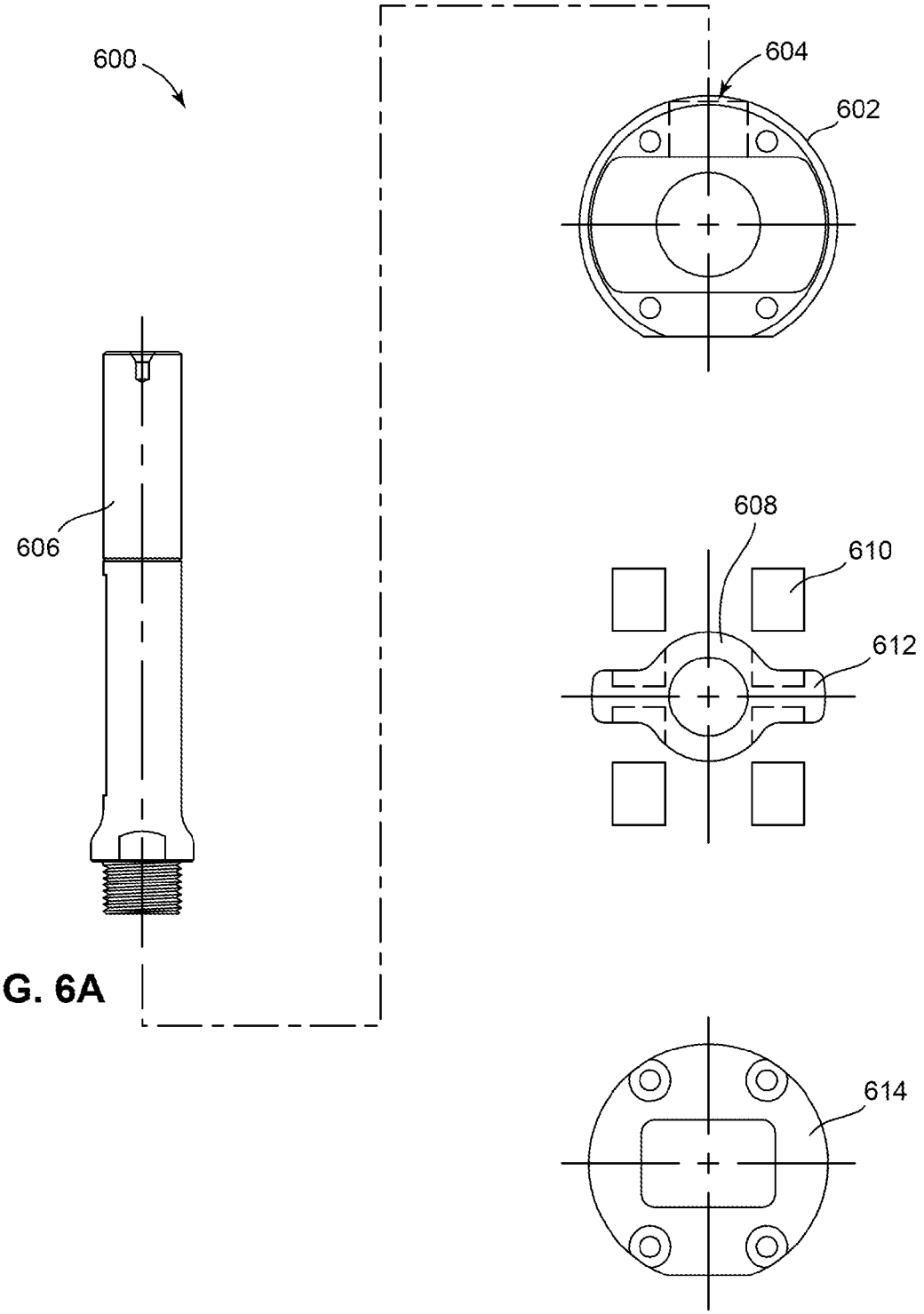
FIG. 6A is an exploded side sectional view of a pivoting connection.
Figure 6C:
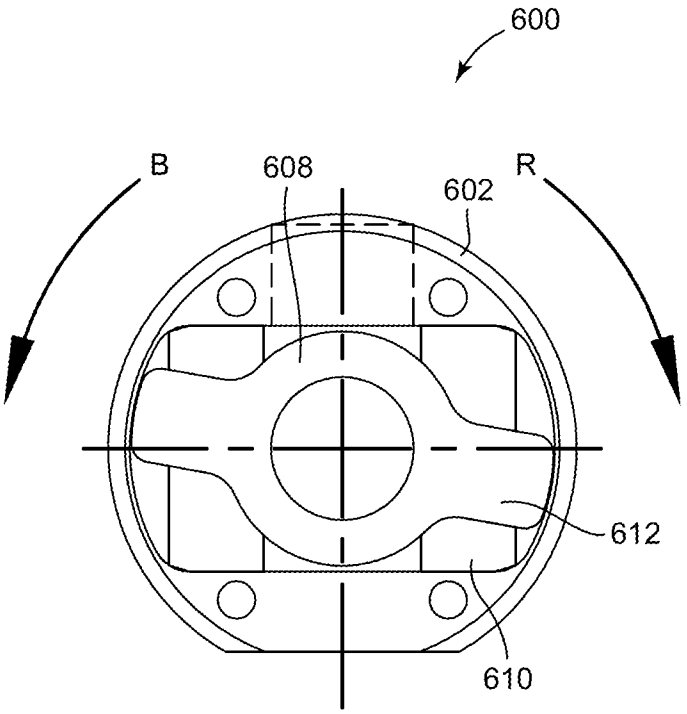
FIGS. 6B and 6C are side sectional views of the pivoting connection of FIG. 6A in a first position and a second position, respectively.
Figure 6B:
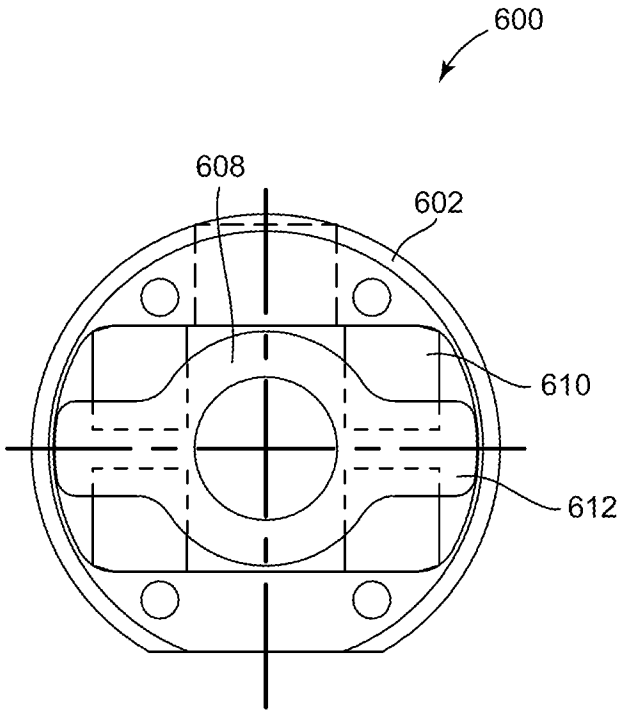

FIGS. 6A-6C depict another embodiment of a pivotable connection 600. This connection 600 includes a housing 602 defining an opening 604 for receiving a bar 606. An axle 608 is received in the housing 602. A pivoting element (not shown) extends out from the axle 608 (substantially orthogonal to bar 606). The axle 608 is biased into a neutral position (as depicted in FIG. 6B), by a plurality of spring elements 610, which may be springs or elastomers. The spring elements 610 exert a balanced biasing force between axle arms 612 and the housing 602. A cover plate 614 closes the internal elements within the housing 602 and provides a bearing supports for the axle 608. As the axle 608 rotates R (FIG. 6C), the arms 612 compress two of the four spring elements 610, which bias B the axle 608 back to the neutral position.

Figure 7A:
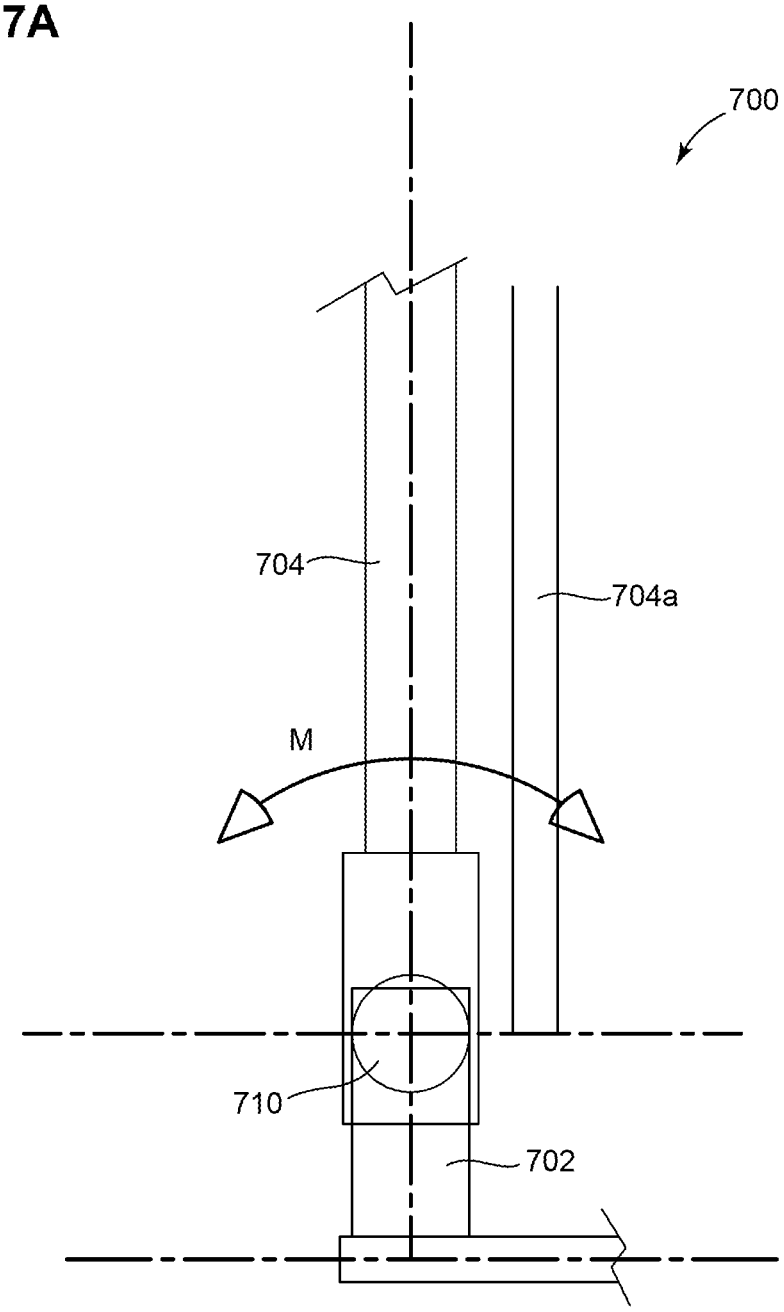
FIG. 7A is a schematic partial side view of a wheelchair.
Figure 7B:
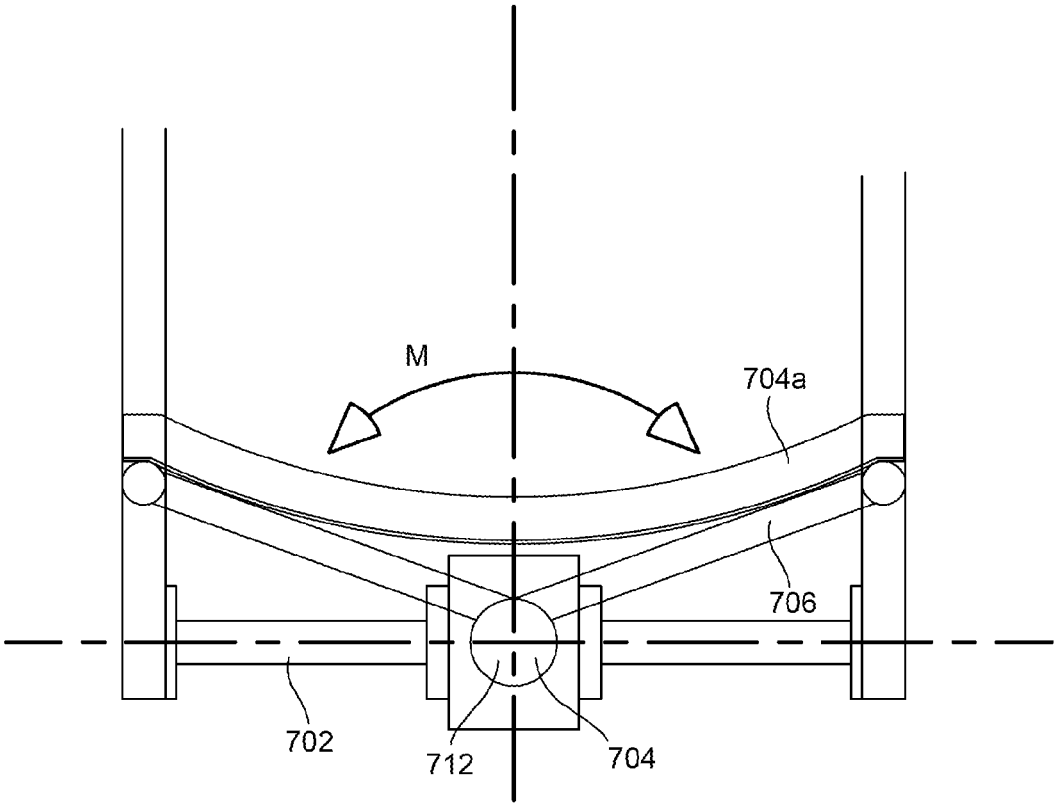
FIG. 7B is a schematic partial top view of a wheelchair.
Figure 7C:
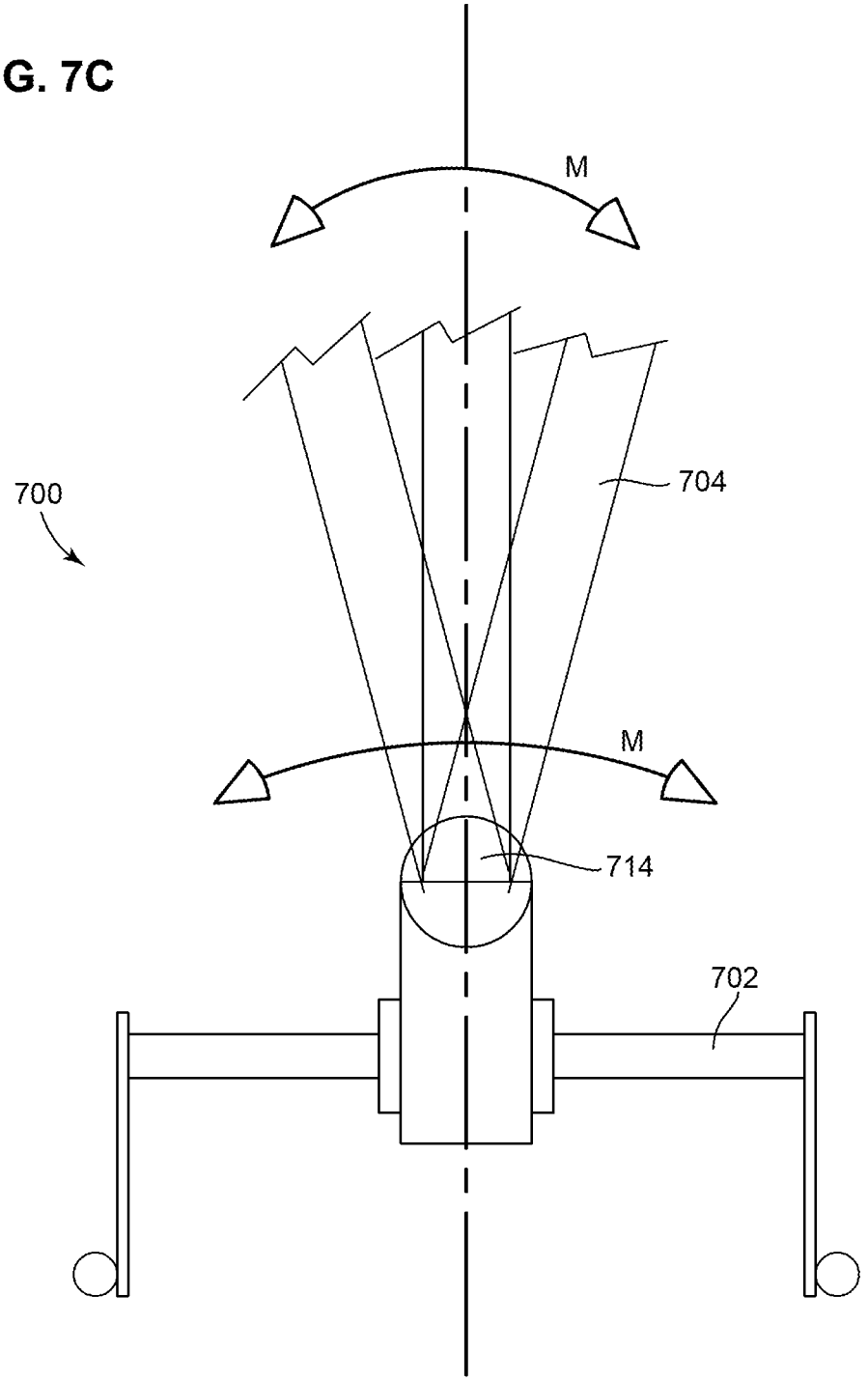
FIG. 7C is a schematic partial rear view of a wheelchair.

The two pivotable connections of FIGS. 5A-6C may be utilized to accommodate any pivoting or rotational movement applied to components of a wheelchair. FIGS. 7A-7C depict a number of locations where a pivotable connection may be located to increase dynamic seating of a wheelchair. FIG. 7A, for example, depicts a partial side view of a wheelchair 700, specifically, an interface between a wheelchair seat member 702 and a wheelchair backrest member 704. A backrest is also depicted. A pivot connection 710 may be utilized proximate that interface for enabling front to rear motion M. This pivoting movement corresponds generally to pivoting movement about axis $A_4$, as depicted in FIG. 1.

FIG. 7B depicts a partial top view of a wheelchair 700, specifically, a backrest mounting structure 706 and the vertical member 704 that extends upward from the wheelchair seat member 702. A pivotable connection 712 may be utilized proximate that interface for enabling twisting motion M. This pivoting movement corresponds generally to pivoting movement about axis A5, as depicted in FIG. 1. Additionally, FIG. 7C depicts a partial rear view of a wheelchair 700, specifically, the vertical member 704 and the wheelchair seat member 702. A pivot connection 714 may be utilized proximate that interface for enabling leaning motion M. This pivoting movement M corresponds generally to pivoting movement about axis $A_6$, as depicted in FIG. 1. Two or more of the pivotable mechanisms 710, 712, 714 described above may be included in a single wheelchair, thus providing a great range of motion in the back member. In an embodiment, a first pivotable mechanism connects a seat member to a first portion of single vertical back member, allowing for pivoting movement about axis $A_4$ (FIG. 1). A second pivotable mechanism is connected to a second portion of the single vertical back member, allowing for pivoting movement about axis $A_5$ (FIG. 1). Finally, a third pivotable mechanism is connected to a third portion of the single vertical back member, allowing for pivoting movement about axis $A_6$ (FIG. 1). This enables a wheelchair to accommodate virtually any movement of an individual seated therein.

The benefits to the individual as a result of the above technology can be categorized as mechanical, economic and therapeutic. The mechanical benefits include improved durable and reduced failure. The economic benefits include a reduction in breakage and failure of the wheelchair, thus providing a repair cost savings the purchaser of the wheelchair. The savings is realized as a result of fewer repairs and extended life of the wheelchair. The therapeutic benefits include a reduction or change in the behavior or condition.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured all such modifications as fall within the spirit and scope of the technology. Accordingly, what is desired to be secured by Letters Patent is the technology as defined and differentiated herein, and all equivalents.

What is claimed is:

1. A pivotable mechanism for a wheelchair, the pivotable mechanism comprising:

an axle comprising at least one axle projection projecting from the axle;

a hub comprising at least one hub projection projecting from a surface of the hub;

a support component secured to the hub, wherein the support component is configured to support a body part of an individual; and a biasing element located between the axle projection and the hub projection, such that rotation of the hub relative to the axle causes a deformation of the biasing element, and wherein the location of the biasing element prevents contact between the axle projection and the hub projection.

2. The pivotable mechanism of claim 1, wherein the axle comprises a plurality of axle projections, and wherein the hub comprises a corresponding plurality of hub projections.

3. The pivotable mechanism of claim 2, further comprising a plurality of biasing elements corresponding to the plurality of axle projections and the plurality of hub projections.

4. The pivotable mechanism of claim 1, wherein the biasing element comprises a compressible element.

5. A wheelchair comprising the pivotable mechanism of claim 1, wherein the pivotable mechanism allows for a pivoting movement about an axis defined by an interface between at least one of (a) a seat member and a back member, (b) a seat member and a footrest, (c) a foot rest and a footplate support, (d) a baseplate and a footplate, and (e) a back member and a headrest.

6. The pivotable mechanism of claim 1, wherein the axle and the hub are substantially coaxial.

7. The pivotable mechanism of claim 6, wherein the axle is located within the hub.

8. The pivotable mechanism of claim 1, wherein the support component comprises a seat member.

9. The pivotable mechanism of claim 1, wherein the support component comprises a backrest member.

10. The pivotable mechanism of claim 1, wherein the mechanism is disposed proximate a backrest member.

11. The pivotable mechanism of claim 1, wherein the pivotable mechanism comprises a plurality of pivotable mechanisms disposed proximate the backrest member.

12. A mobile seating device comprising:

a seat member;

a single backrest member; and a pivotable mechanism connected to both the seat member and the single backrest member, wherein the pivotable mechanism enables pivotable movement of the single backrest member relative to the seat member, wherein the pivotable mechanism comprises:

a first projection secured relative to the seat member;

a second projection secured relative to the single backrest member; and a biasing element disposed between and in contact with both the first projection and the second projection, wherein the biasing element exerts a resistance between the first projection and the second projection when the first projection moves relative to the second projection.

13. The mobile seating device of claim 12, wherein the at least a portion of the single backrest member substantially surrounds a portion of the seat member.

14. The mobile seating device of claim 13, wherein the pivotable mechanism is disposed within the portion of the single backrest member that substantially surrounds the portion of the seat member.

15. The mobile seating device of claim 12, wherein the pivotable mechanism comprises a pin for setting an initial position of the first projection relative to the second projection.

16. The mobile seating device of claim 12, wherein the biasing element comprises an elastomer.

* * * * *